United States Patent [19]

Kurtz et al.

[11] 3,996,438

[45] Dec. 7, 1976

[54] VACUUM-TYPE CIRCUIT INTERRUPTER WITH TWO SETS OF CONTACTS ELECTRICALLY IN PARALLEL

[75] Inventors: Donald R. Kurtz, West Chester; Joseph C. Sofianek, Broomall, both of Pa.

[73] Assignee: General Electric Company, Philadelphia, Pa.

[22] Filed: May 19, 1975

[21] Appl. No.: 579,122

[52] U.S. Cl. ..... 200/144 B; 200/146 AA; 313/217

[51] Int. Cl.[2] ..... H01H 9/40

[58] Field of Search ..... 200/144 B, 145, 146; 313/217

[56] References Cited

UNITED STATES PATENTS

| | | | |
|---|---|---|---|
| 3,321,598 | 5/1967 | Streater | 200/144 B |
| 3,643,047 | 2/1972 | Rich | 200/144 B |
| 3,679,474 | 7/1972 | Rich | 313/217 |

*Primary Examiner*—Gerald P. Tolin
*Attorney, Agent, or Firm*—William Freedman

[57] ABSTRACT

A vacuum-type circuit interrupter comprises two pluralities of rod electrodes positioned to form a ring of electrodes in which the electrodes of the first plurality interleave with those of the second plurality and are spaced circumferentially of the ring from the immediately adjacent electrodes of the second plurality. A first conductive tube mounts the electrodes of the first plurality on a first conductive end cap of the interrupter, and a second conductive tube mounts the electrodes of the second plurality on a second conductive end cap of the interrupter. First and second stationary contacts are respectively mounted on the distal ends of a rod electrode in said second plurality and a rod electrode in said first plurality. A first movable contact rod extends through said first end cap and through said first tube and carries a movable contact for engaging said first stationary contact. A second movable contact rod extends through said second end cap and through said second tube and carries a movable contact for engaging said second stationary contact. The two pairs of engageable contacts are electrically connected in parallel with each other when the interrupter is closed.

17 Claims, 4 Drawing Figures

VACUUM-TYPE CIRCUIT INTERRUPTER WITH TWO SETS OF CONTACTS ELECTRICALLY IN PARALLEL

BACKGROUND

This invention relates to an electric circuit interrupter of the vacuum type and, more particularly, to a circuit interrupter of this type which comprises two sets of relatively movable contacts electrically connected in parallel for carrying continuous current through the interrupter.

In most vacuum interrupters, the force required to hold a pair of separable contacts in engagement during the passage of high current therethrough varies directly with the square of the current. It has been recognized that this force can be reduced by providing a plurality of sets of contacts electrically connected in parallel for sharing the total current through the interrupter. One way of constructing such an interrupter is to mount the movable contact of each pair on the usual long, slender movable contact rod and to arrange these movable contact rods in close side-by-side relationship. A problem involved in such an arrangement is that the high magnetic forces developed between the movable contact rods when high currents flow therethrough tend to force the rods together, making it difficult to properly guide and operate the contact rods. One way of dealing with this problem is disclosed and claimed in our copending application Ser. No. 546,475, filed Feb. 3, 1975, and assigned to the assignee of the present invention. This applicaton has now issued as U.S. Pat. No. 3,969,598.

A general object of our invention is to construct a vacuum type circuit interrupter comprising parallel-connected pairs of contacts in such a way as to reduce the transversely-directed magnetic forces acting on the movable contact rods during high currents as compared to those transversely-acting forces usually present in prior side-by-side contact rod arrangements such as referred to above.

Another object is to construct a vacuum-type circuit interrupter comprising parallel-connected contacts in such a way that the contacts can be accommodated within an envelope of relatively small diameter as compared to that needed when the contact pairs are disposed in side-by-side relationship.

One embodiment of our invention employs interleaving rod electrodes, such as shown and claimed in U.S. Pat. No. 3,679,474-Rich, assigned to the assignee of the present invention, for carrying the arcing current after arcing has been initiated at the separable contacts.

Another object is to combine the parallel-connected contacts of the interrupter with these rod electrodes in such a way that the interrupter effects a prompt transfer of arcing current from the inner-contact gaps to the gaps between the rod electrodes.

SUMMARY

In carrying out the invention in one form, we provide an evacuated envelope comprising first and second metal end caps at its opposite ends. Within the envelope are two pluralities of rod electrodes. A first conductive tube mounts the first plurality of rod electrodes on the first end cap and electrically connects the first end cap to the first plurality of electrodes. A second conductive tube mounts the second plurality of electrodes on said second end cap and electrically connects said second plurality of electrodes to said second end cap. The first and second plurality of rod electrodes are positioned so as to form a ring of electrodes in which the electrodes of the first plurality interleave with the electrodes of the second plurality and are spaced circumferentially of the ring from the immediately adjacent electrodes of said second plurality. First and second stationary contacts are respectively mounted on the distal ends of a rod electrode in said second plurality and a rod electrode in said first plurality. The stationary contacts are located in positions spaced from each other longitudinally of said ring on a reference line surrounded by said ring. A first movable contact rod extends through said first end cap and through said first tube and carries a movable contact which is arranged to engage said first stationary contact. A second movable contact rod extends through said second end cap and through said second tube and carries a movable contact which is arranged to engage said second stationary contact. The pairs of engageable contacts are electrically connected in parallel with each other when the interrupter is closed.

BRIEF DESCRIPTION OF DRAWINGS

For a better understanding of the invention, reference may be had to the accompanying drawings, wherein.

DETAILED DESCRIPTION OF PREFERRED EMBODIMENTS

Figure 1:
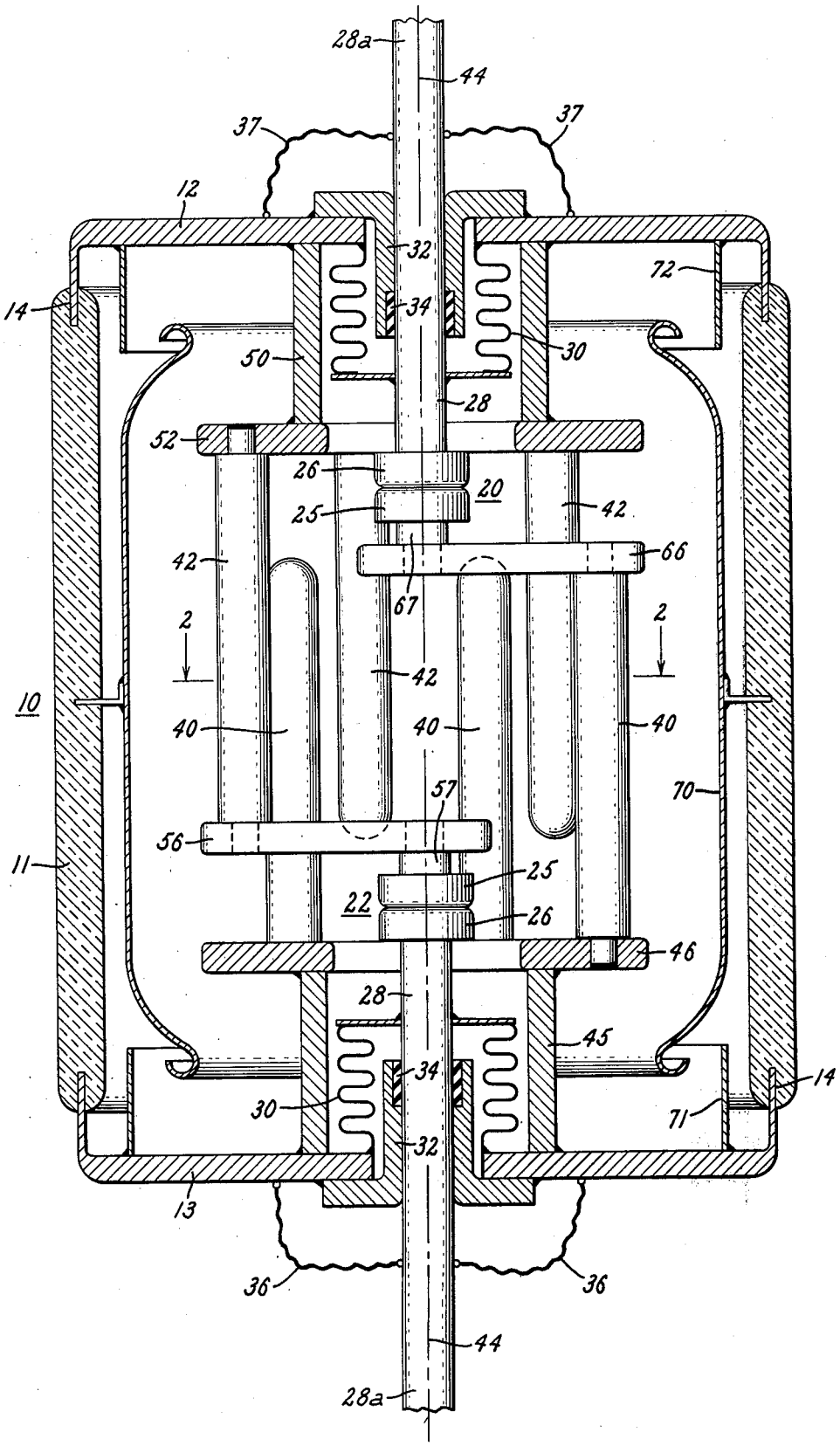
FIG. 1 is a side elevational view mostly in cross-section showing a vacuum interrupter embodying one form of our invention. The section is along the line 1—1 of FIG. 2.

Referring now to FIG. 1, the illustrated vacuum interrupter comprises a highly evacuated envelope 10 that comprises a tubular housing 11 of insulating material and a pair of metal end caps 12 and 13 disposed at opposite ends of the housing and sealed thereto by conventional seals 14.

The interrupter comprises two pairs 20 and 22 of separable contacts electrically connected in parallel with each other in a manner that will soon become apparent. Contact pair 20 is located near the upper end cap 12, and contact pair 22 is located near the lower end cap 13. Each contact pair comprises a generally stationary contact 25, supported in a manner soon to be described, and a movable contact 26 vertically movable into and out of engagement with stationary contact 25. The movable contact 26 of each pair is brazed to the inner end of a vertically-movable conductive contact rod 28 that extends through the adjacent end cap.

For providing a seal between each contact rod 28 and the envelope, an elongated metal bellows 30 is provided for each contact rod. Each of these bellows has one end joined to the contact rod by a suitable vacuum-tight joint and its opposite end joined to the adjacent end cap by another suitable vacuum-tight joint. The bellows allows the contact rod to be moved vertically without impairing the vacuum inside the envelope.

To assist in guiding each contact rod 28 for substantially straight-line motion along its longitudinal axis, a tubular guide 32, preferably a non-magnetic material, is provided around each contact rod. This guide 32 has a radially extending flange that is fixed to the adjacent end cap. At the inner end of guide 32, there is a sleeve bearing 34, preferably of Teflon, fixed to the guide and slidably receiving contact rod 28.

Each movable contact rod 28 is electrically connected to the end cap through which it extends by suitable flexible conductive braid. Such braid is schematically shown at 36 and at 37. The purpose of this braid will soon appear more clearly.

The interrupter also includes an interleaving rod electrode arrangement of the general type disclosed and claimed in the aforesaid Rich U.S. Pat. No. 3,679,474. This arrangement comprises a first plurality of rod electrodes 40 mounted on and electrically connected to lower end cap 13 and a second plurality of rod electrodes 42 mounted on and electrically connected to upper end cap 12. The rod electrodes 40 and 42 are positioned so as to form a generally circular ring of electrodes concentrically surrounding the central longitudinal axis 45 of the interrupter. The upwardly-projecting electrodes 40 interleave with and longitudinally overlap the downwardly-projecting electrodes 42 and are spaced circumferentially of the ring from the immediately adjacent electrodes 42. Since alternate electrodes are connected to opposite end caps, the juxtaposed electrodes are considered to alternate in polarity when the interrupter is open.

For electrically connecting the upwardly-projecting rod electrodes 40 to the lower end cap 13 and for supporting them thereon, a conductive tube 45 is provided adjacent the lower end cap 13 and is brazed thereto at its lower end. A conductive disc 46 is brazed to the upper end of tube 45, and the lower end of rod electrodes 40 are suitably joined to this conductive disc 46. A corresponding conductive tube 50 and disc 52 are provided adjacent upper end cap 12 for electrically connecting the downwardly-projecting rod electrodes 42 to the upper end cap 12 and for supporting these electrodes on the upper end cap.

For supporting the stationary contact 25 of the lower pair 22 of contacts, a radially-extending conductive bar 56 is provided at the lower, or distal, end of one of the downwardly-projecting rod electrodes 42. The outer end of bar 56 is brazed to the distal end of this rod electrode 42, and the inner end of bar 56 is brazed to an extension 57 of the stationary contact. A corresponding conductive bar 66 supports the stationary contact 25 of the upper set 20 on the upper, or distal, end of one of the upwardly-projecting rod electrodes 40. The outer end of this bar 66 is brazed to the distal end of this electrode 40, and the inner end of bar 66 is brazed to an extension 67 of upper stationary contact 25.

The outer ends **28*a* of the two contact rods 28 may be thought of as the terminals of the interrupter. When the interrupter is closed, current entering through lower terminal 28*a* flows upwardly through the interrupter via either of two electrically parallel paths. One path is through the series combination of lower contact rod 28, lower contact pair 22, and parts 57, 56, 42, 52, 50, 12, and 37. The other path is through the series combination of parts 36, 13, 45, 46, 40, 66, 67, upper contact pair 20, and the upper contact rod 28**. These two paths are constituted by substantially identical parts, as a result of which their impedances are substantially equal, thus forcing the total current to divide substantially equally between them. Since only about half the total current passes through each pair of contacts as compared to an interrupter where there is only a single pair of contacts, the force required to hold each of our sets of contacts closed against the magnetic forces developed by a given total current through the interrupter is only about one-fourth that required in the case of the interrupter with a single pair of contacts. This means the total force required on our two sets of contacts is only about one-half that required in an interrupter with a single set of contacts. This substantial reduction in force requirements is a distinct advantage in that it permits a substantial reduction in the size of the required closing mechanism.

Figure 2:
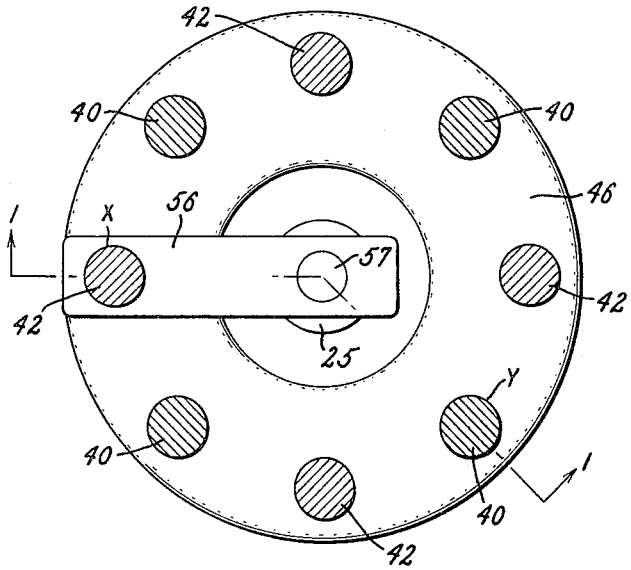
FIG. 2 is a cross-sectional view along the line 2—2 of FIG. 1.

For effecting opening of the interrupter, the two movable contact rods 28 are driven outwardly of the interrupter from their illustrated closed positions to effect substantially simultaneous contact-separation at the two sets of contacts 20 and 22. Closing is effected after such an opening operation by simultaneously returning the movable contact rods 28 to their illustrated positions to produce substantially simultaneous contact-engagement at the two contact pairs 20 and 22. The linkage for effecting such contact-rod motion is not shown since it can be of any suitable conventional design, e.g., that illustrated in FIG. 2 of application Ser. No. 499,740-Crouch et al now U.S. Pat. No. 3,914,568, filed Aug. 22, 1974, and assigned to the assignee of the present invention.

During a circuit-interrupting operation, the substantially simultaneous contact-separation occurring at the two contact pairs 20 and 22 normally results in an arc being established between the contacts 25, 26 of each pair. Ionized arcing products from these arcs are quickly propogated into the gaps between the adjacent rod electrodes 40 and 42, causing these inter-electrode gaps to break down electrically, thus forming diffuse arcs between juxtaposed pairs of rod electrodes. These diffuse arcs extend circumferentially of the envelope and are capable of carrying relatively high currents without the formation of anode spots, as is explained in the aforesaid Rich U.S. Pat. No. 3,679,474. Although current may sometimes continue to flow through the inter-contact gaps after arcs are established between the rod electrodes, this inter-contact current is only a small percentage of the total current and does not prevent interruption at an early current zero. It is to be noted that in the embodiment of FIG. 1 since the tube 45 is positioned beneath the inter-contact gap at contact pair 22, the tube does not interfere with the desired free communication between the inter-contact gap and the inter-electrode gaps. The upper tube 50 is likewise in a non-interfering position with respect to free communication between the upper inter-contact gap at 20 and the inter-electrode gaps.

For protecting the insulating housing 11 from being coated by arc-generated metallic particles, a plurality of tubular metal shields 70, 71, and 72 are provided. Central shield 70 is electrically isolated from the end caps 12 and 13, and shields 71 and 72 are end shields electrically connected to the end caps. These shields act in a known manner to intercept and condense arc-generated metallic vapors before they can reach the insulating housing 11.

As pointed out hereinabove, one of the objects of our invention is to reduce the transversely-acting magnetic forces on the movable contact rods of the interrupter as compared to those present in a side-by-side contact rod arrangement. We accomplish this objective in our illustrated interrupter of FIG. 1 by locating the two contact pairs 20 and 22 at longitudinally-spaced positions rather than side-by-side, by locating the movable contact rods 28 at opposite ends of the interrupter instead of side-by-side, and by carrying current to one contact pair past the other contact pair through a conductive tube such as 45 or 50. The current flowing through tube 45 or 50 can distribute itself circumferentially with respect to the tube, thus reducing the magnetic forces between the current paths through contact rod 28 and the adjacent conductor.

It is recognized that the tubes 45 and 50 extend along only a portion of the length of the two parallel conducting paths and thus do not substantially affect the transverse magnetic forces at all points on the parallel paths, but there is no great need for such force-reduction along much of the unenclosed length of the current paths, especially along most of the length of the rod electrodes 40 and 42. This is the case because the particular rod electrodes 40 and 42 that carry current when the interrupter is closed are transversely spaced by a relatively great distance, and this large spacing limits the force between these rod electrodes. These two rod electrodes are designated X and Y in FIG. 2, where it can be seen that X and Y are angularly spaced by about 135° about the ring of rod electrodes and thus are relatively far apart. Moreover, since the rods 40 and 42 are stationary parts, it is feasible to make them relatively thick and strong in order to withstand the transverse forces that are present. But where the part subject to the transverse forces is a movable contact rod such as 28, there are more severe practical limits on how thick it can be since its mass must be kept relatively low. Moreover, less transverse deflection of the movable contact rod can be tolerated since this rod is required to smoothly move within its guide 32, 34, which it cannot do if appreciably bent. Another factor contributing to reduced mass for each contact rod 28 is that the contact rod can be relatively short since the associated contact pair is located relatively close to the end cap through which the rod extends into the interrupter. This allows reduced penetration of the rod into the interrupter.

It will be apparent that we are able to accommodate the two pairs of parallel contacts within an envelope of relatively small diameter because they are spaced longitudinally of the envelope rather than being side-by-side and because the contact rods enter the envelope from opposite ends rather than from the same ends, thus eliminating any lateral spacing requirements between the contact rods.

Figure 3:
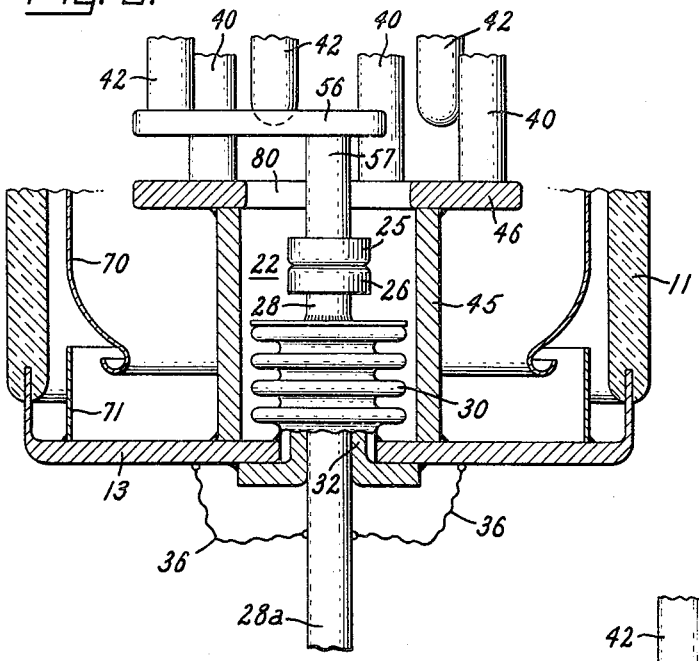
FIG. 3 is a sectional view of a portion of a vacuum interrupter embodying another form of our invention.

FIG. 3 illustrates another embodiment of the invention. One respect in which this embodiment differs from that of FIG. 1 is in its utilizing a tube 45 which extends upwardly past the contact pair 22, thus locating the contact pair 22 within the tube 45. Although not shown in FIG. 3, the upper tube of the interrupter, corresponding to tube 50 in FIG. 1, is lengthened as compared to that of FIG. 1, and the upper contact pair 20 is located within this tube 50. In the embodiment of FIG. 3, the lower tube 45 and the upper tube (not shown) are of a highly conductive metal, such as copper or aluminum. For purposes of this application, a metal with a conductivity substantially lower than that of aluminum is considered to be not highly conductive.

Locating each contact pair within its corresponding tube reduces the transversely-acting magnetic force on the movable contact rod 28 since the tube extends along the entire length of the movable contact rod 28 that is located within the interrupter. There is no inner portion of the movable contact rod projecting beyond the inner end of the tube as in FIG. 1. Most significantly, all of the movable contact rod located above the guide bearing 34 is located within the tube 45. In FIG. 3 the tube 45, by extending around a portion of stationary contact support 57, even serves to limit the transversely-acting magnetic force on the stationary contact support.

The greater length of the tube 45 of FIG. 3 is also advantageous in that it contributes to more uniform distribution of current around the circumference of the tube, especially in the region surrounding the movable contact rod 28 and the movable contact 26. This greater uniformity of distribution contributes to lower transverse forces on the movable contact rod.

Locating the separable contacts 25, 26 within the tube 45 somewhat restricts free communication between the inter-electrode gaps and the inter-contact gap established between contacts 25 and 26 when the contacts are separated, but sufficient communication is still present to force prompt initiation of arcs across the inter-electrode gaps following contact-separation. Tube 45 serves the additional desirable purpose of intercepting most of the relatively large molten particles generated by arcing at the contacts, thereby protecting the rest of the interrupter from such particles; but sufficient vapor still escapes from tube 45 through its relatively large open upper end 80 to force prompt initiation of arcs across the inter-electrode gaps.

The use of a metal tube around the contacts of an inter-leaving rod-electrode vacuum interrupter for intercepting and condensing large molten particles generated by inter-contact arcing before the particles can deposit on the rod electrodes is disclosed and claimed more broadly in Application Ser. No. 589,892-Rich, filed June 24, 1975, and assigned to the assignee of the present invention. The invention of said Rich application was made prior to the present invention and, therefore, we make no claim herein to said broad invention of Rich.

Figure 4:
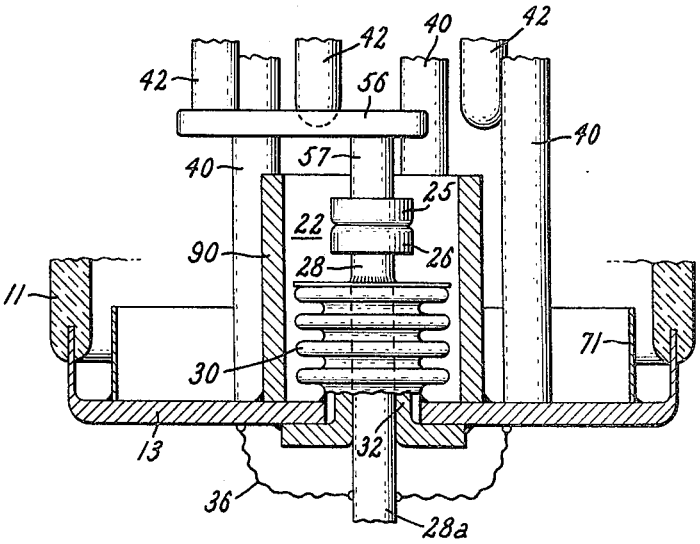
FIG. 4 is a sectional view of still another embodiment of our invention.

FIG. 4 shows another embodiment of the invention, wherein the same reference numerals are used as in FIGS. 1 and 3 to designate corresponding parts of the interrupter. In this embodiment, there is provided about contacts 25, 26 a tube 90 which serves as an eddy-current shield. This tube is made of high conductivity metal such as copper. The rod electrodes 40 are not supported on this tube, as in FIGS. 1 and 3, but rather extend past the tube and are supported directly on the end cap 13. The tube 90 is disposed within the reference ring on which the rod electrodes 40 are located. Although not shown, a substantially identical tube and rod electrode construction is provided at the upper end of the interrupter.

In the embodiment of FIG. 4, magnetic flux developed by current flowing through one of the rods 40 adjacent tube 90 induces eddy currents in the tube 90 which develop opposing flux to limit penetration of flux from rod 40 into the interior of the tube. This flux-cancellation effect helps to limit the transversely acting magnetic forces tending to attract contact rod 28 to the rod electrode 40, thereby substantially reducing the likelihood that the movable contact rod will be bent by magnetic forces resulting from very high currents through the interrupter. The embodiment of FIG. 4, though quite simple, is somewhat less effective in reducing forces on the movable contact rod than the other illustrated embodiments.

During an interrupting operation, the ionized arcing products developed by the inter-contact arc are propogated into the inter-electrode gaps, thereby igniting these gaps and causing diffuse arcs to be established thereacross, all in the same manner as in the other embodiments.

While we have shown and described particular embodiments of our invention, it will be obvious to those skilled in the art that various changes and modifications may be made without departing from our invention in its broader aspects; and we, therefore, intend in the appended claims to cover all such changes and modifications as fall within the true spirit and scope of our invention.

What we claim as new and desire to secure by Letters Patent of the United States is:

1. In a vacuum-type circuit interrupter:

a. a highly evacuated envelope comprising an insulating housing and first and second metal end caps at opposite ends of said housing, b. a first plurality of rod electrodes within said envelope and means comprising a first conductive tube for mounting said first plurality of rod electrodes on said first end cap and for electrically connecting said first plurality of rod electrodes to said first end cap when the interrupter is open, c. a second plurality of rod electrodes within said envelope and means comprising a second conductive tube for mounting said second plurality of rod electrodes on said second end cap and for electrically connecting said second plurality of rod electrodes to said second end cap when the interrupter is open, d. said first and second pluralities of electrodes being positioned so as to form a ring of electrodes within said envelope, the electrodes of said first plurality interleaving with and longitudinally overlapping the electrodes of said second plurality and being spaced circumferentially of said ring from the immediately adjacent electrodes of said second plurality, said electrodes alternating in polarity about said ring when the interrupter is open, whereby inter-electrode gaps are defined between the juxtaposed interleaving electrodes of said first and second pluralities, e. a first generally stationary contact mounted on the distal end of a rod electrode of said second plurality in a first position on an axis extending longitudinally of said ring and surrounded by said ring, f. a second generally stationary contact mounted on the distal end of a rod electrode of said first plurality in a second position on an axis extending longitudinally of said ring and surrounded by said ring, g. said first and second positions being spaced from each other longitudinally of said ring, h. first and second movable contacts for respectively engaging said first and second generally stationary contacts, i. a first movable contact rod on which said first movable contact is mounted extending in sealed relationship through said first metal end cap, j. a second movable contact rod on which said second movable contact is mounted extending in sealed relationship through said second metal end cap, k. said first conductive tube surrounding said first contact rod, and said second conductive tube surrounding said second contact rod, l. said two pairs of engageable contacts being electrically connected in parallel with each other while said interrupter is closed.

2. The interrupter of claim 1 in which said two movable contact rods are operated substantially simultaneously during an opening operation to effect substantially simultaneous contact-separation at said two pairs of engageable contacts.

3. The interrupter of claim 1 in which:

a. said pairs of engageable contacts are separated substantially simultaneously to develop arcs therebetween during an interrupting operation, and b. the arcing products from said arcs enter said inter-electrode gaps and induce electrical breakdown of said inter-electrode gaps.

4. The interrupter of claim 1 in which:

a. arcs are established between said engageable contacts upon separation thereof during an opening operation, and b. the arcing products from said arcs enter said inter-electrode gaps and induce electrical breakdown of said inter-electrode gaps.

5. The interrupter of claim 1 in which said first stationary and movable contacts are located outside said first conductive tube when said first contacts are in engagement.

6. The interrupter of claim 5 in which said second stationary and movable contacts are located outside said second conductive tube when said second contacts are in engagement.

7. The interrupter of claim 1 in which said first stationary and movable contacts are located within said first conductive tube when said first contacts are in engagement but there is still sufficient communication between the inter-contact gap formed upon separation of said first contacts and the inter-electrode gaps to produce prompt electrical breakdown of said inter-electrode gaps following arc-initiation at said first inter-contact gap.

8. The interrupter of claim 7 in which said second stationary and movable contacts are located within said second conductive tube when said second contacts are in engagement.

9. The interrupter of claim 1 in which when the interrupter is closed, there are two electrically parallel current paths through said interrupter respectively extending through said two pairs of engageable contacts, said parallel paths having generally equal impedances so as to distribute the total current through the interrupter generally equally between said parallel paths.

10. In a vacuum type circuit interrupter:

a. a highly evacuated envelope comprising an insulating housing and first and second metal end caps at opposite ends of said housing, b. a first plurality of rod electrodes within said envelope mounted on said first end cap and electrically connected to said first end cap when the interrupter is open, c. a second plurality of rod electrodes within said envelope mounted on said second end cap and electrically connected to said second end cap when the interrupter is open, d. said first and second pluralities of electrodes being positioned so as to form a ring of electrodes within said envelope, the electrodes of said first plurality interleaving with the electrodes of said second plurality and being spaced circumferentially of said ring from the immediately adjacent electrodes of said second plurality, said electrodes alternating in polarity about said ring when the interrupter is open, whereby inter-electrode gaps are defined between the juxtaposed interleaving electrodes of said first and second pluralities, e. a first generally stationary contact mounted on the distal end of a rod electrode of said second plurality in a first position on an axis extending longitudinally of said ring and surrounded by said ring, f. a second generally stationary contact mounted on the distal end of a rod electrode of said first plurality in a second position on an axis extending longitudinally of said ring and surrounded by said ring, g. said first and second positions being spaced from each other longitudinally of said ring, h. first and second movable contacts for respectively engaging said first and second generally stationary contacts, i. a first movable contact rod on which said first contact rod is mounted extending in sealed relationship through said first metal end cap, j. a second movable contact rod on which said second contact is mounted extending in sealed relationship through said second metal end cap, k. a first flux-shielding tube of highly conductive metal fixed to said first end cap, surrounding said first movable contact rod in the region adjacent said first movable contact, and located between said first movable contact rod and the rod electrodes of said first plurality, and l. a second flux-shielding tube of highly conductive metal fixed to said second end cap, surrounding said second movable contact rod in the region adjacent said second movable contact, and located between said second movable contact rod and the rod electrodes of said second plurality, m. said two pairs of engageable contacts being electrically connected in parallel with each other while said interrupter is closed.

11. The vacuum interrupter of claim 10 in which said first stationary and movable contacts are located within said first flux-shielding tube when said first contacts are in engagement but there is still sufficient communication between the inter-contact gap formed upon separation of said first contacts and the inter-electrode gaps to produce prompt electrical breakdown of said inter-electrode gaps following arc-initiation at said inter-contact gap.

12. The interrupter of claim 11 in which said second stationary and movable contacts are located within said second conductive tube when said second contacts are in engagement.

13. The interrupter of claim 10 in which when the interrupter is closed, there are two electrically parallel current paths through said interrupter respectively extending through said two pairs of engageable contacts, said parallel paths having generally equal impedances so as to distribute the total current through the interrupter generally equally between said parallel paths.

14. In a vacuum-type circuit interrupter:

a. a highly evacuated envelope comprising an insulating housing and first and second metal end caps at opposite ends of said housing, b. a first plurality of rod electrodes within said envelope electrically connected to said first end cap both when the interrupter is open and closed, c. a second plurality of rod electrodes within said envelope electrically connected to said second end cap both when the interrupter is open and closed, d. said first and second pluralities of electrodes being positioned so as to form a ring of electrodes within said envelope, the electrodes of said first plurality interleaving with and longitudinally overlapping the electrodes of said second plurality and being spaced circumferentially of said ring from the immediately adjacent electrodes of said second plurality both when the interrupter is open and closed, said electrodes alternating in polarity about said ring when the interrupter is open, whereby inter-electrode gaps are defined between the juxtaposed interleaving electrodes of said first and second pluralities, e. a first generally stationary contact mounted on the distal end of a rod electrode of said second plurality in a first position on an axis extending longitudinally of said ring and surrounded by said ring, f. a second generally stationary contact mounted on the distal end of a rod electrode of said first plurality in a second position on an axis extending longitudinally of said ring and surrounded by said ring, g. said first and second positions being spaced from each other longitudinally of said ring, h. first and second movable contacts for respectively engaging said first and second generally stationary contacts, i. a first movable contact rod on which said first movable contact is mounted extending in sealed relationship through said first metal end cap, j. a second movable contact rod on which said second movable contact is mounted extending in sealed relationship through said second metal end cap, k. said two pairs of engageable contacts being electrically connected in parallel with each other while said interrupter is closed, l. means effective when the interrupter is closed for distributing the current flowing through said first set of contacts about the circumference of said second movable contact rod in the region where said current through said first set of contacts flows past said second movable contact rod, and m. means effective when the interrupter is closed for distributing the current flowing through said second set of contacts about the circumference of said first movable contact rod in the region where said latter current flows past said first movable contact rod.

15. The interrupter of claim 14 in which said two movable contact rods are operated substantially simultaneously during an opening operation to effect substantially simultaneous contact-separation at said two pairs of engageable contacts.

16. The interrupter of claim 14 in which:

a. said pairs of engageable contacts are separated substantially simultaneously to develop arcs therebetween during an interrupting operation, and b. the arcing products from said arcs enter said inter-electrode gaps and induce electrical breakdown of said inter-electrode gaps.

17. The interrupter of claim 14 in which when the interrupter is closed, there are two electrically parallel current paths through said interrupter respectively extending through said two pairs of engageable contacts, said parallel paths having generally equal impedances so as to distribute the total current through said interrupter generally equally between said parallel paths.

* * * * *